United States Patent [19]

Cooper et al.

[11] Patent Number: 4,658,181

[45] Date of Patent: Apr. 14, 1987

[54] TRAVELLING WAVE TUBES

[75] Inventors: Brian F. Cooper; Maurice Esterson, both of Chelmsford, England

[73] Assignee: English Electric Valve Company Limited, Chelmsford, England

[21] Appl. No.: 658,790

[22] Filed: Oct. 9, 1984

[30] Foreign Application Priority Data

Oct. 7, 1983 [GB] United Kingdom ..... 8326854

[51] Int. Cl.[4] ..... H01J 1/14

[52] U.S. Cl. ..... 313/346 R; 313/341; 313/346 DC; 315/3.5; 315/343

[58] Field of Search ..... 313/346 R, 346 DC, 341, 313/345; 315/3.5, 343, 341, 342, 346

[56] References Cited

U.S. PATENT DOCUMENTS

| | | | |
|---|---|---|---|
| 3,633,062 | 1/1972 | Tamura | 313/346 |
| 4,129,801 | 12/1978 | Soeno et al. | 313/346 R |
| 4,310,777 | 1/1982 | Fukushima et al. | 313/346 R |
| 4,349,766 | 9/1982 | Ando et al. | 313/345 |
| 4,388,551 | 6/1983 | Ray | 313/341 |
| 4,459,322 | 7/1984 | Lin | 313/346 R |
| 4,471,267 | 9/1984 | Amboss | 315/3.5 |
| 4,553,064 | 11/1985 | Amboss | 315/3.5 |

FOREIGN PATENT DOCUMENTS

| | | |
|---|---|---|
| 151710 | 9/1920 | United Kingdom . |
| 335573 | 9/1930 | United Kingdom . |
| 361130 | 11/1931 | United Kingdom . |
| 534575 | 3/1941 | United Kingdom . |
| 728114 | 3/1955 | United Kingdom . |
| 833432 | 4/1960 | United Kingdom . |

OTHER PUBLICATIONS

J. Turnbull, One-Piece Bimetal Cathode Cup and Sleeve, Jul. 23, 1976, 1-2, RCA.

*Primary Examiner*—David K. Moore
*Assistant Examiner*—M. Razavi
*Attorney, Agent, or Firm*—Spencer & Frank

[57] ABSTRACT

The invention provides a travelling wave tube having a directly heated cathode. Cathode material is applied in a depression in one U-shaped member of a high resistance alloy material and the return path for heater current is provided by another U-shaped strip member beneath the first. The configurations of the two strip members are similar so that stray magnetic fields generated by the equal but opposite currents flowing therein, tend to neutralize one another. In another embodiment the two strip members are replaced by generally cylindrical members, one member being within the other. The surface of the member providing the return path for heater current is polished where it faces the member carrying the cathode material so as to reflect back heat radiated by the last-mentioned member.

17 Claims, 5 Drawing Figures

TRAVELLING WAVE TUBES

BACKGROUND OF THE INVENTION

This invention relates to travelling wave tubes.

Conventional travelling wave tubes employ cathodes which are indirectly heated by radiation or conduction from a heating element. Such cathodes tend to be of high thermal mass and the time taken for the cathode to attain operating temperature from switching on of the heater element tends to be relatively long. In many cases this is not an inconvenience. For certain applications, however, it is highly desirable to reduce the time taken for the cathode to attain operating temperature and one object of the present invention is to provide an improved travelling wave tube of which the cathode exhibits relatively rapid start characteristics.

SUMMARY OF THE INVENTION

According to this invention a travelling wave tube has a cathode which is directly heated, a substrate carrying the emissive material of said cathode forming part of the path for heater current through one layer of a double layered member of which the second layer forms a return path for said heater current and has a configuration, at least in the region of said cathode material, which conforms closely to that of said first layer whereby the effects of stray magnetic fields tending to be generated by the passage of said heater current through said first layer, tend to be neutralized.

With a travelling wave tube in accordance with the present invention the direct heating of the cathode material tends to ensure a relatively rapid warming up of the cathode material to its operating temperature. However, if a simple cathode mount through which heater current was passed, were to be employed, the relatively high currents involved would result in stray magnetic fields which could significantly modify the performance of the travelling wave tube. If the heating current is alternating spurious modulation and noise may be increased. If the heating current is direct current, defocussing of the electron beam may be experienced.

Preferably, the emitting surface of said cathode material is, as known per se, spherical and said first layer is preferably formed with a spherical depression into which cathode emitting material is introduced. Preferably said second layer is formed with a corresponding depression.

Said first and second layers may be strip-like in form but other shapes and configurations are possible.

For example, in one example of travelling wave tubes in accordance with the present invention the two layers are generally cylindrical in shape with one generally cylindrical member, providing the return path for heater current, being within the other.

Where said first and second layers are strip-like in form, preferably said two layers are of similar widths (that is to say of similar dimensions in a direction transverse to the directions of current flow). However, in some such cases, said second layer may be narrower than said first layer.

Preferably said one layer is formed of a high resistance alloy such as nickel tungsten. Preferably again said second layer is formed of a low resistance material such as molybdenum or copper.

Preferably the surface of said second layer which faces towards said first layer is provided with a highly reflective finish (for example by plating or polishing) so that heat radiated from said one layer is reflected back towards that one layer in order to contribute to the heating effect of said cathode material.

Because the strength of a magnetic field decreases with increasing distance from a current carrying conductor giving rise to the field it is in fact difficult if not impossible to approach total neutralization with two conductive layers which are spaced one from the other and carrying the same current. Preferably therefore, means are provided whereby the current through said one layer is relatively lower than the current through said second layer.

Preferably said last mentioned means comprises an impedance connected in shunt with said first layer.

Said impedance may be within or without the envelope of said tube and while it may be of predetermined fixed value, preferably said impedance is adjustable.

Where the heater current is an alternating current, in order to mitigate the effects of eddy currents, it may be advantageous to decrease the current in said first layer relative to that in said second layer to a greater extent than would be the case if the heater current were to be direct current.

BRIEF DESCRIPTION OF THE DRAWINGS

The invention is illustrated in, and further described with reference to the accompanying drawings of which.

DESCRIPTION OF THE PREFERRED EMBODIMENTS

Figure 1:
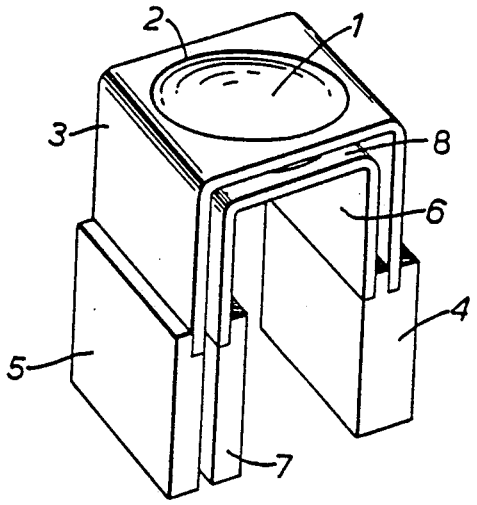
FIGS. 1, 2 and 3 illustrate the cathode structures of three different examples of travelling wave tube in accordance with the present invention.

Referring to FIG. 1 the cathode emitting material 1 of the cathode is provided within a spherical depression 2 within a U-shaped strip 3 of a high resistance alloy, in this case nickel tungsten. The U-shaped strip 3 is located within and supported by two blocks of copper referenced 4 and 5 respectively.

Beneath, as viewed, the U-shaped strip 3 is another U-shaped strip 6 of a low resistance material, in this case molybdenum. While strip 6 is spaced from the underside of strip 3 the two strips closely conform to one another in their configurations. In this example, both strips are of similar widths (i.e. of similar dimensions in a direction transverse to the directions of current flow).

U-shaped strip 6 is mounted in, and supported at one end, by the copper block 4 and at its other end by an independent copper block 7.

The surface 8 of strip 6 facing the strip 3 is polished, on all three sides, so as to reflect back to strip 3 any heat that radiates in the direction of strip 6 from strip 3.

In operation heater current is passed from copper block 5 to copper block 7 via strips 3 and 6. Part of strip 3 forms a substrate for the cathode material of course, with strip 6 forming the return path. Thus, currents flowing in strips 3 and 6 are equal but opposite so that stray magnetic fields generated by the current passing through the two strips, tend to neutralize one another.

Figure 2:
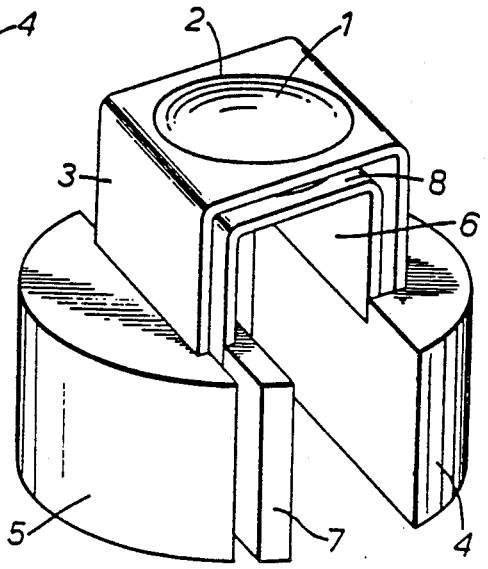

Referring to FIG. 2 the cathode arrangement illustrated therein is essentially similar to that illustrated in FIG. 1 (and like references are used for like parts) save for the shapes of the copper blocks 4, 5 and 7. In the case of FIG. 2 these are shaped so that their exterior surfaces which are extensive in the direction of the axis of the travelling wave tube, lie upon an imaginary cylinder for ease of mounting and accommodation within the envelope of the travelling wave tube.

Figure 3:
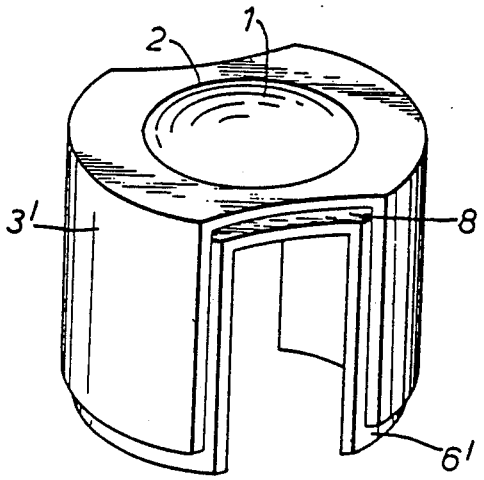

Referring to FIG. 3 in this case a cathode arrangement is shown in which the strips 3 and 6 are replaced by generally cylindrical members referenced 3' and 6'. Otherwise the arrangement is similar to that described with reference to FIG. 1, with member 3' being of nickel tungsten and member 6' being of molybdenum. Again the cathode material 1 is provided within a depression 2 in member 3' and the surfaces of member 6' which face member 3' are polished. While not shown, one side of generally cylindrical member 3' together with the corresponding side of generally cylindrical member 6' are mounted together in a block 4 which generally corresponds to the block 4 as illustrated in FIG. 2 whilst the other sides of generally cylindrical members 3' and 6' are mounted respectively in blocks 5 and 7 corresponding generally to the blocks 5 and 7 as illustrated in FIG. 2.

Figure 4:
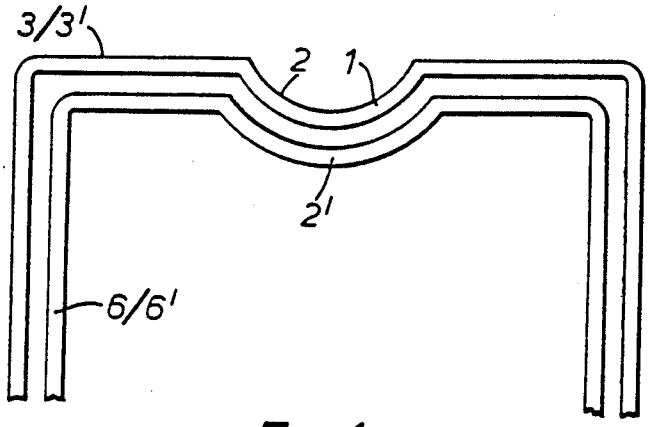
FIG. 4 illustrates a feature of all three structures not apparent from the views taken in FIGS. 1, 2 and 3.

Referring to FIG. 4, this illustrates in schematic fashion a feature of all three structures described with reference to FIGS. 1 to 3 i.e. that the second layers (strip 6 in the case of FIGS. 1 and 2 and member 6' in the case of FIG. 3) exhibit a cylindrical depression 2' which corresponds to the cylindrical depression 2 within which the cathode emitting material is provided.

Figure 5:
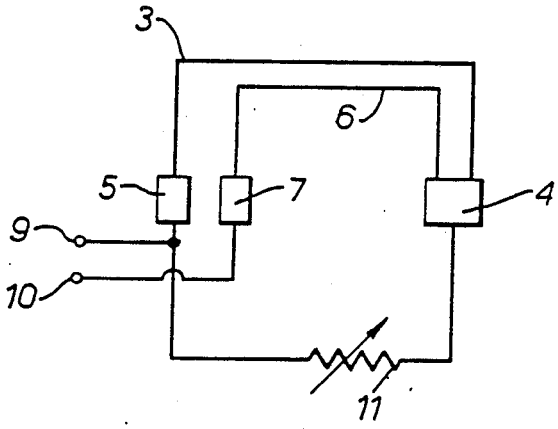
FIG. 5 illustrates a modification. In all figures, like references are used for like parts.

Referring to FIG. 5 this illustrates a modification which, although described as applied to the structure of FIG. 1, may be applied to any of the arrangements described hereinbefore. Represented are the strips 3,6 and the copper blocks 4, 5 and 7 with blocks 5 and 7 connected to heater current supply terminals.

Connected electrically in shunt with strip 3 is a current limiting impedance 11. In this case impedance 11 is outside of the tube envelope and adjustable so as adjustably to reduce the current flowing in strip 3 compared to the current flowing in strip 6. This takes into account the fact that the strength of a magnetic field decreases with increasing distance from the current carrying conductor which creates it and by providing for the field produced by the current in conductor 6 to be greater than that produced by the current in conductor 3, a degree of compensation is achieved for the distance necessarily separating the two conductors. Impedance 11 may be adjusted to optimize the neutralization effect achieved.

We claim:

1. In a travelling wave tube, a directly heated cathode comprising a first electrically conductive layer having outer and inner surfaces and first and second ends, the outer surface of said electrically conductive layer having a concave spherical depression therein;

emissive material carried in said spherical depression; and a second electrically conductive layer having an outer surface and first and second ends, the first end of said second layer being connected to the second end of said first layer so that a heater current flows through said first and second layers when a voltage is applied across the first end of said first layer and the second end of said second layer, said second layer being spaced from and conforming closely to said first layer at least at the portion of said first layer having said spherical depression carrying said emissive material, whereby the effect of a stray magnetic field generated by the passage of said heater current through said first layer tends to be neutralized by the passage of said heater current through said second layer.

2. A directly heated cathode comprising a first electrically conductive layer having outer and inner surfaces and first and second ends, the outer surface of said electrically conductive layer having a concave spherical depression therein;

emissive material carried in said spherical depression; and a second electrically conductive layer having an outer surface and first and second ends, the first end of said second layer being connected to the second end of said first layer so that a heater current flows through said first and second layers when a voltage is applied across the first end of said first layer and the second end of said second layer, the outer surface of said second layer being spaced from and conforming closely to the inner surface of said first layer at least at the portion of said first layer having said spherical depression carrying said emissive material, whereby the effect of a stray magnetic field generated by the passage of said heater current through said first layer tends to be neutralized by the passage of said heater current through said second layer.

3. A tube as claimed in claim 1 wherein said second layer is formed with a depression corresponding in position to the depression in said first layer.

4. A tube as claimed in claim 1 wherein said first and second layers are strip-like in form.

5. A tube as claimed in claim 4 wherein said two layers are of similar widths.

6. A tube as claimed in claim 1 wherein said first and second layers are generally cylindrical in shape, the outer surface of said second layer being adjacent the inner surface of said first layer whereby said second cylindrical layer is within said first cylindrical layer.

7. A tube as claimed in claim 1 wherein said first layer is formed of a high resistance alloy.

8. A tube as claimed in claim 7 wherein said alloy is nickel tungsten.

9. A tube as claimed in claim 1 wherein said second layer is formed of a low resistance material.

10. A tube as claimed in claim 9 wherein said low resistance material is molybdenum.

11. A tube as claimed in claim 1 wherein the outer surface of said second layer facing towards the inner surface of said first layer is provided with a highly reflective finish so that heat radiated from said first layer is reflected back towards said first layer thereby contributing to the heating effect of said emissive material.

12. A tube as claimed in claim 11 wherein said outer surface of said second layer is polished.

13. A tube as claimed in claim 11 wherein said outer surface of said second layer is plated.

14. A tube as claimed in claim 1 wherein current limiting means are provided to reduce the current through said first layer with respect to the current through said second layer.

15. A tube as claimed in claim 14 wherein said current limiting means comprises an impedance connected in shunt with said first layer.

16. A tube as claimed in claim 15 wherein said travelling wave tube is provided with an envelope and said impedance is located outside of said envelope.

17. A tube as claimed in claim 16 wherein said impedance is adjustable.

* * * * *